US007972156B2

(12) United States Patent
Zhou et al.

(10) Patent No.: US 7,972,156 B2
(45) Date of Patent: Jul. 5, 2011

(54) ELECTRONIC CARD CONNECTOR WITH AN IMPROVED HOUSING FOR ASSEMBLING A SWITCH TERMINAL THEREOF FAVORABLY

(75) Inventors: Feng Zhou, Kunshan (CN); Jian-Fei Yu, Santa Clara, CA (US); Qi-Jun Zhao, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/862,964

(22) Filed: Aug. 25, 2010

(65) Prior Publication Data

US 2011/0053396 A1 Mar. 3, 2011

(30) Foreign Application Priority Data

Aug. 25, 2009 (CN) ..... 2009 2 0308703

(51) Int. Cl.
*H01R 29/00* (2006.01)

(52) U.S. Cl. ..... 439/188

(58) Field of Classification Search ..... 439/188, 439/630, 631, 489, 752, 352
See application file for complete search history.

(56) References Cited

U.S. PATENT DOCUMENTS

| | | | | |
|---|---|---|---|---|
| 6,394,827 | B2 * | 5/2002 | Nogami | 439/159 |
| 6,805,566 | B2 * | 10/2004 | Chia-Chen | 439/188 |
| 6,932,615 | B1 * | 8/2005 | Yeo | 439/63 |
| 7,112,077 | B2 * | 9/2006 | Kikuchi | 439/188 |
| 7,128,613 | B1 * | 10/2006 | Lee et al. | 439/630 |
| 7,416,429 | B1 * | 8/2008 | Hung | 439/188 |
| 2004/0259403 | A1 * | 12/2004 | Chang | 439/188 |
| 2008/0090437 | A1 * | 4/2008 | Huang et al. | 439/188 |

FOREIGN PATENT DOCUMENTS

JP 3079490 6/2000

* cited by examiner

*Primary Examiner* — Chandrika Prasad
(74) *Attorney, Agent, or Firm* — Wei Te Chung; Andrew C. Cheng; Ming Chieh Chang

(57) ABSTRACT

An electronic card connector includes an insulative housing, a number of contacts and a first switch terminal retained on the insulative housing. The insulative housing has a receiving space, a receiving slot communicating with the receiving space along an up to down direction and a limiting block at a front side of the receiving slot. The first switch terminal has a fastening portion retained on the insulative housing, a connecting portion forwardly extending to the receiving slot, a limiting portion forwardly extending to a lower side of the limiting block and a tail portion. The switch terminal further has a guiding portion extending sidewardly. The insulative housing has a pre-pressing surface at one side of the receiving slot to pre-press the guiding portion and prevent the switch terminal from bouncing upwardly to resist a front side of the limiting block in an assembly process of the switch terminal.

20 Claims, 7 Drawing Sheets

ELECTRONIC CARD CONNECTOR WITH AN IMPROVED HOUSING FOR ASSEMBLING A SWITCH TERMINAL THEREOF FAVORABLY

BACKGROUND OF THE INVENTION

1. Field of the Invention

The present invention relates to electronic card connectors, more particularly to electronic card connector with an improved housing for assembling a switch terminal thereof favorably.

2. Description of Related Art

Nowadays, electronic card connectors are widely used in computers, mobile phones, cameras, et al. to receive an electronic card. The electronic card presents as a media for storing documents and transmitting the documents to the computers, mobile phones, cameras via the electronic card connectors. An electronic card connector usually includes an insulative housing, a number of contacts retained on the insulative housing, and a pair of switch contacts retained to the insulative housing for detecting whether the electronic card is inserted to the electronic card connector. The insulative housing has a bottom wall, at least a side wall extending upwardly from one side of the bottom wall and a receiving space between the bottom wall and the side wall. The bottom wall has a retaining slot extending therethrough along an up to down direction for receiving the switch contacts and a projection at a rear side of the retaining slot.

The switch contacts include a lower contact and an upper contact contacting with each other along the up to down direction when the electronic card is inserted into the receiving space. The upper contact has a first retaining portion retained at a front side of the bottom wall, a spring arm backwardly extending into the receiving space to contact with the electronic card. The lower contact has a second retaining portion retained at the front side of the bottom wall and a connecting portion backwardly extending to a lower side of the spring arm. The spring arm can be pressed downwardly by the electronic card to electrically contact with the connecting portion. The connecting portion has a free end pressed by the projection for preventing the connecting portion from moving or deformed upwardly to contact with the spring arm when the electronic card is not inserted into the receiving space. The upper and lower contacts are assembled to the insulative housing along a back to front direction.

However, in an assembly process of the switch contacts, the free end of the lower contact is not pre-pressed before the free end moves to the pre-determined position below the projection, thereby the free end of the lower contact would easily moves or deformed upwardly to resist a front side of the projection, which results in a deformation of the lower contact and affects a detecting effort of the switch contacts.

Hence, an improved electronic card connector is desired to overcome the above problems.

BRIEF SUMMARY OF THE INVENTION

According to one aspect of the present invention, an electronic card connector, comprises: an insulative housing having a receiving space, a receiving slot communicating with the receiving space along an up to down direction and a limiting block at a front side of the receiving slot; a plurality of contacts retained on the insulative housing; and a first switch terminal having a fastening portion retained on the insulative housing, a connecting portion forwardly extending to the receiving slot, a limiting portion forwardly extending to a lower side of the limiting block and a tail portion extending out of the insulative housing; wherein the switch terminal has a guiding portion extending sidewardly, the insulative housing has a pre-pressing surface at one side of the receiving slot to pre-press the guiding portion and prevent the switch terminal from bouncing upwardly to resist a front side of the limiting block in an assembly process of the switch terminal.

According to another aspect of the present invention, an electronic card connector, comprises: an insulative housing having a receiving space, a receiving slot communicating with the receiving space and a limiting block at a front side of the receiving slot; a plurality of contacts retained on the insulative housing; and a first switch terminal having a fastening portion retained on the insulative housing, a middle portion forwardly extending from a front end of the fastening portion, a connecting portion upwardly and forwardly extending from middle portion to the receiving slot, a limiting portion forwardly extending to a bottom surface of the limiting block and a tail portion extending out of the insulative housing; wherein the insulative housing has a pre-pressing section behind the limiting block along a front to back direction, the pre-pressing section is lower than the bottom surface and pre-presses the connecting portion downwardly to prevent the connecting portion from bouncing upwardly to resist a front side of the limiting block in an assembly process of the first switch terminal.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
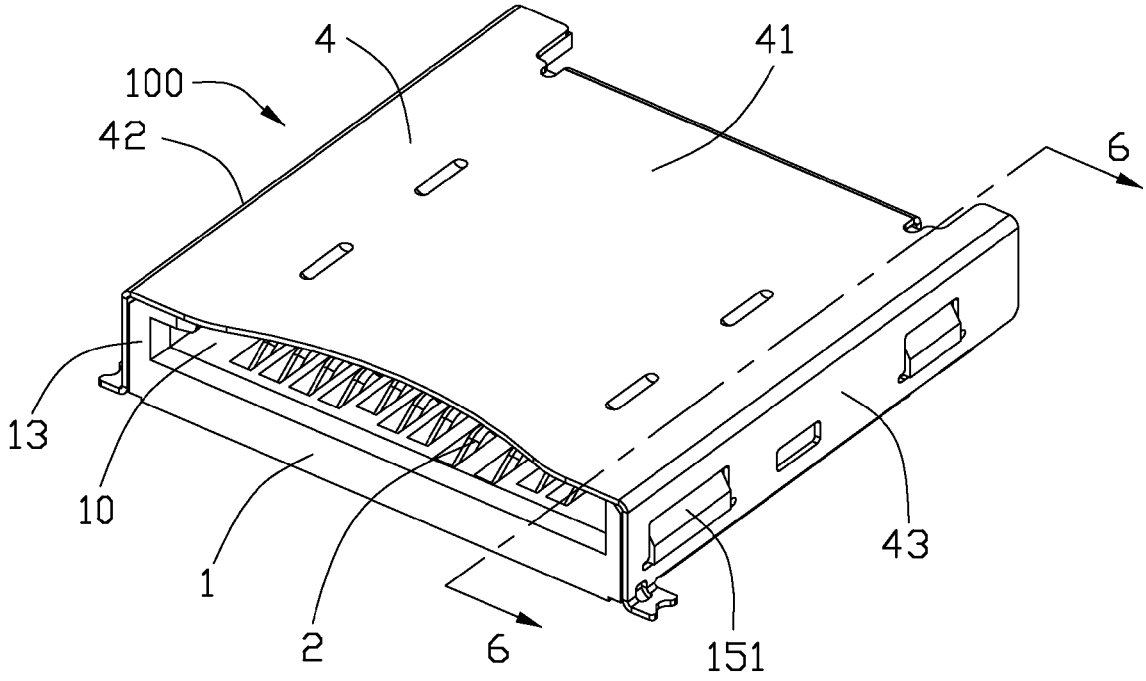
FIG. 1 is a perspective view of an electronic card connector according to the present invention.
Figure 2:
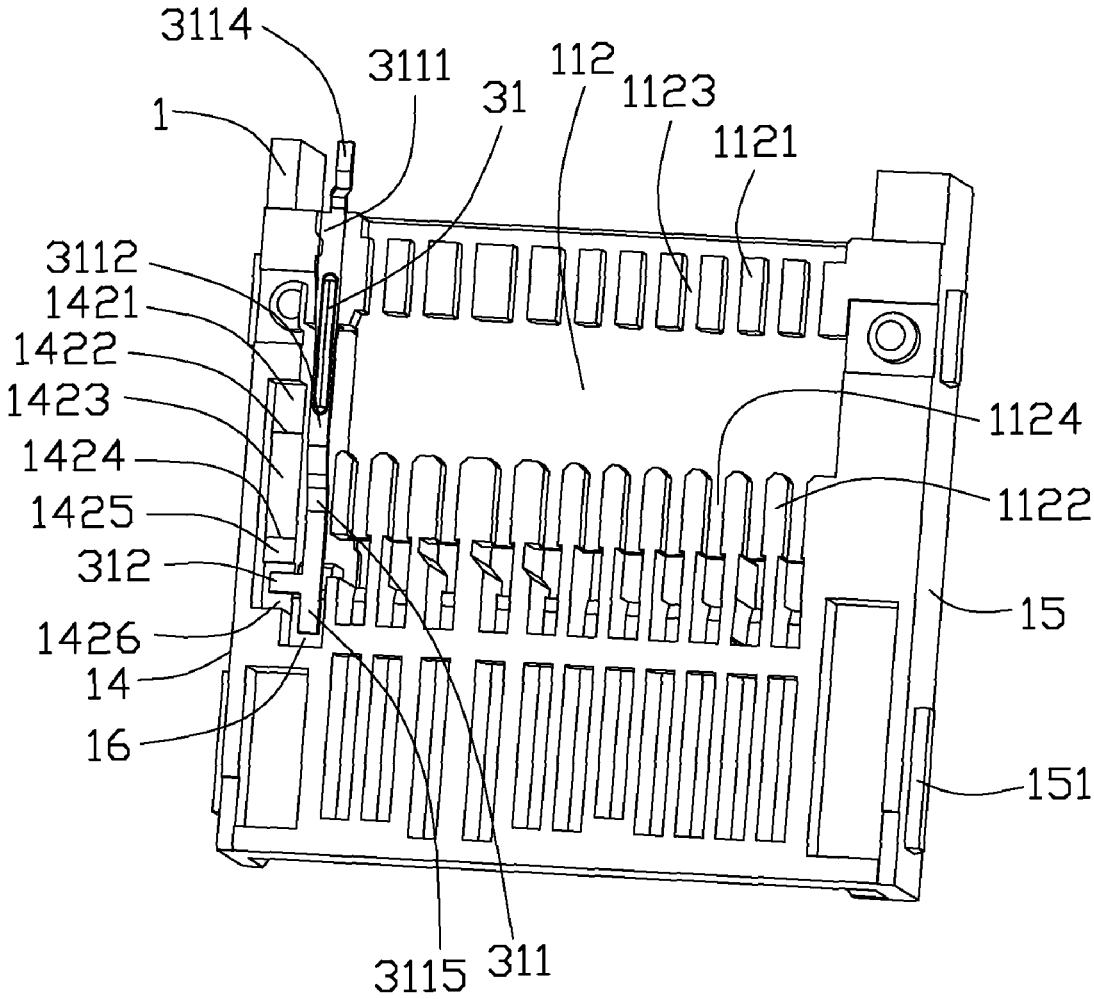
FIG. 2 is a partly perspective view of the electronic card connector shown that a first terminal is completely retained to an insulative housing thereof.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Referring to FIGS. 1-7, an electronic card connector 100 for mating with at least a first electronic card (not shown) and a second electronic card according to the present invention is disclosed. The first electronic card is wider than the second electronic card. The electronic card connector 100 comprises an insulative housing 1, a plurality of contacts 2 and a pair of switch terminals 3 retained on the insulative housing 1, and a metal shell 4 covering the insulative housing 1.

Figure 4:
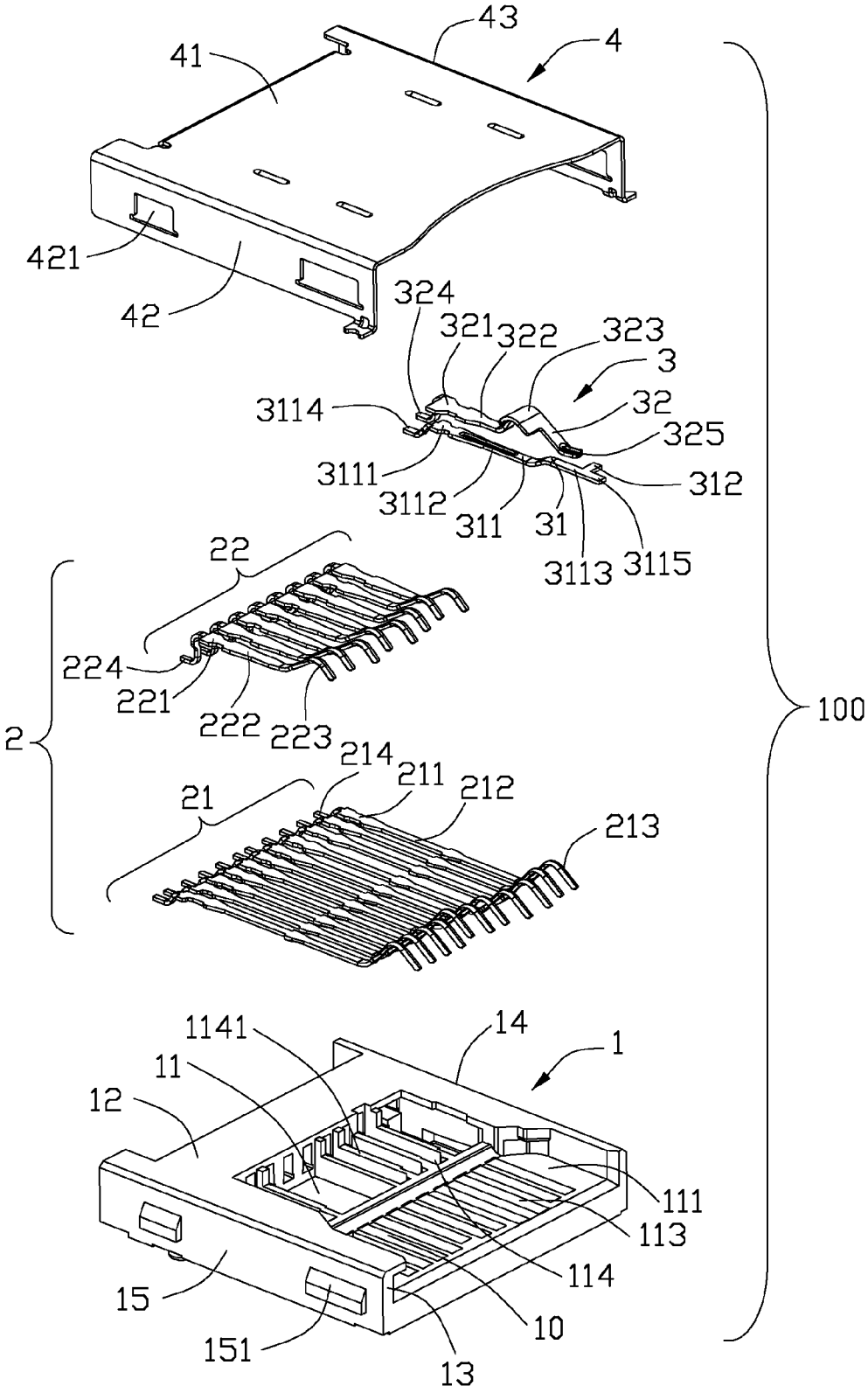
FIG. 4 is an exploded view of the electronic card connector shown in FIG. 1.
Figure 5:
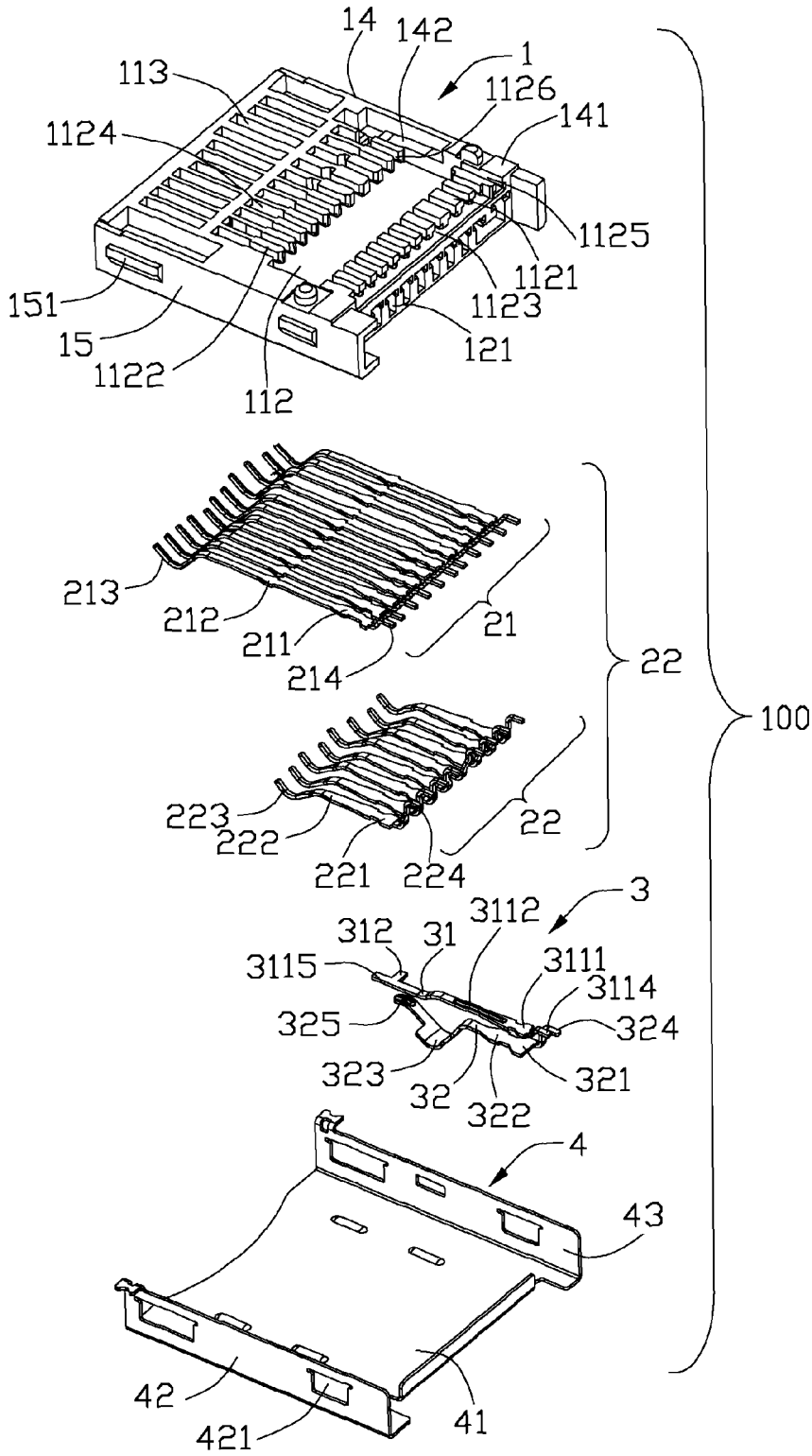
FIG. 5 is a view similar to FIG. 4, while taken from a different aspect.

Referring to FIGS. 4-5, the insulative housing 1 has a bottom wall 11, a mounting wall 12 upwardly extending from a rear end of the bottom wall 11, and a first side wall 14 and a second side wall 15 respectively extending upwardly from two sides of the bottom wall 11, and a receiving space 10 between the bottom wall 11, mounting wall 12 and side walls 14, 15. The bottom wall 11 has a mating surface 13 at a front end thereof.

The bottom wall 11 has an upper surface 111 upwardly facing to the receiving space 10 and a lower surface 112. The bottom wall 11 defines a plurality of first receiving slots 113 extending therethrough at a front side thereof, and a plurality of first blocks 1141 upwardly extending into the receiving space 10 from a rear side of the upper surface 111 to form a plurality of second receiving slots 114 therebetween. The first slots 113 and second slots 114 are respectively arranged in a row along a transverse direction of the insulative housing 1.

The bottom wall 11 defines a plurality of first mounting slots 1123 recessed from a rear side of the lower surface 112, and a plurality of third receiving slots 1124 recessed from a middle side of the lower surface 112. The third receiving slots 1124 align to the first mounting slots 1123 respectively along a front to back direction and communicate with the first receiving slots 113 along the front to back direction. The third receiving slots 1124 extend through the bottom wall 11. The bottom wall 11 is formed with a plurality of second blocks 1121 between adjacent first mounting slots 1123, and a plurality of third blocks 1122 between adjacent third receiving slots 1124. A lateral second block 1121 and the first side wall 14 defines a second mounting slot 1125 therebetween for retaining the switch terminals 3. A lateral third block 1122 and the first side wall 14 defines a fourth receiving slot 1126 therebetween. The fourth receiving slot 1126 extends through the bottom wall 11 and communicates with the second mounting slot 1125 along the front to back direction. The mounting wall 12 defines a plurality of third mounting slots 1124 extending therethrough along the front to back direction and located at an upper side of the first and second mounting slots 1123, 1125.

The first side wall 14 defines a bottom surface 141 and a pre-pressing surface 142 at an upper side of the bottom surface 141. The pre-pressing surface 142 is located at a front side of the second mounting slot 1125 along the front to back direction and an outer side of the fourth receiving slot 1126 along the transverse direction. The pre-pressing surface 142 has a first level surface 1421 horizontally extending at a rear side thereof, an inclined surface 1423 upwardly and forwardly extending from a front end 1422 of the first level surface 1421, a second level surface 1425 horizontally extending from a front end 1424 of the inclined surface 1423, and a third level surface 1426 raised relative to the second level surface 1425 and extending horizontally. The first and second side walls 14, 15 have a plurality of protrusions 151 extending outwardly to engage with the metal shell 4.

The bottom wall 11 is formed with a limiting block 16 at front of the fourth receiving slot 1126. The first level surface 1421, the inclined surface 1423 and the second level surface 1425 are located behind the limiting block 16 along the front to back direction. The third level surface 1426 is located at outside of the limiting block 16. The limiting block 16 presents as step-type and is formed with a first step surface 161 extending horizontally at a bottom side thereof, a vertical surface 163 vertically extending upwardly from a rear end of the first step surface 161, and a second step surface 162 horizontally extending rearwardly from a top end of the vertical surface 163. The first step surface 161 is higher than the second level surface 1425 and lower than the third level surface 1426.

The contacts 2 comprise a plurality of first contacts 21 and a plurality of second contacts 22. Each first contact 21 has a first retaining portion 211 retained in the first mounting slot 1123, a first extension portion 212 forwardly extending into the third receiving slot 1124 from a front end of the first retaining portion 211, a first contact portion 213 cantileveredly received in the first receiving slot 113 and upwardly protruding into the receiving space 10, and a first tail portion 214 extending out of the mounting wall 12 from a rear end of the first retaining portion 211. Each second contact 22 has a second retaining portion 221 retained in the third mounting slot 121, a second extension portion 222 forwardly extending into the second receiving slot 114 from a front end of the second retaining portion 221, a second contact portion 223 upwardly protruding into the receiving space 10 from a front end of the second extension portion 222, and a second tail portion 224 extending out of the mounting wall 12 from a rear end of the second retaining portion 221.

The number of the first contacts 21 are more than that of the second contacts 22, therefore, the first contacts 21 are used to electrically connect with the first electronic card, while the second contacts 22 are used to electrically connect with the second electronic card. The first contact portions 213 are arranged in a row at a front side of the receiving space 10. The second contact portions 223 are arranged in another row behind the first contact portions 213 and higher than the first contact portions 213.

Figure 6:
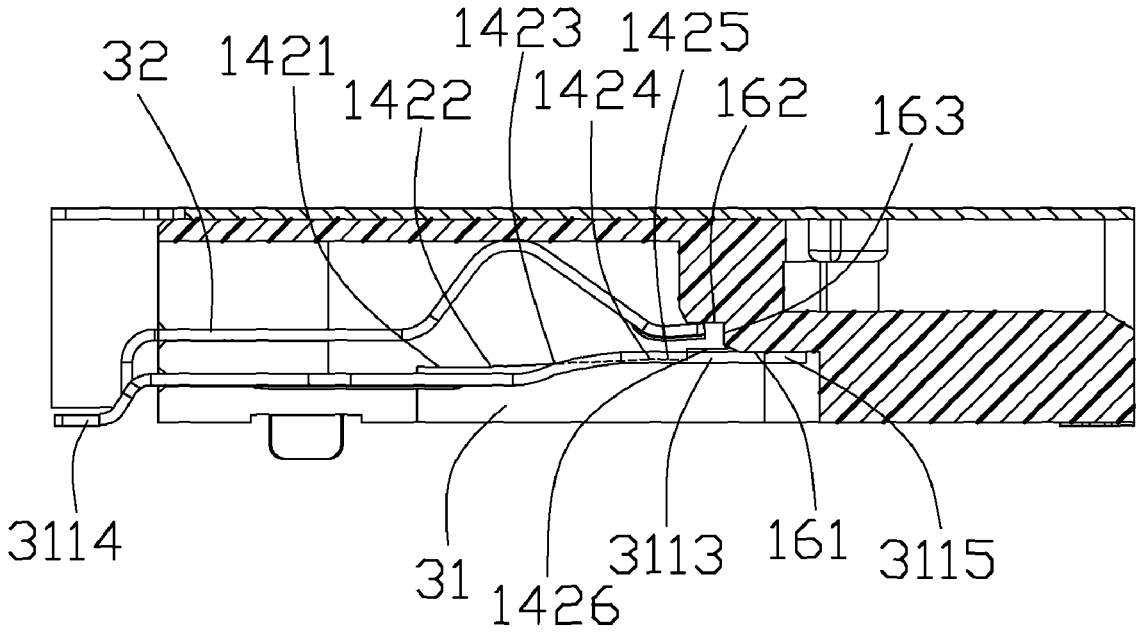
FIG. 6 is a cross sectional view taken along line 6-6 of FIG. 1.
Figure 7:
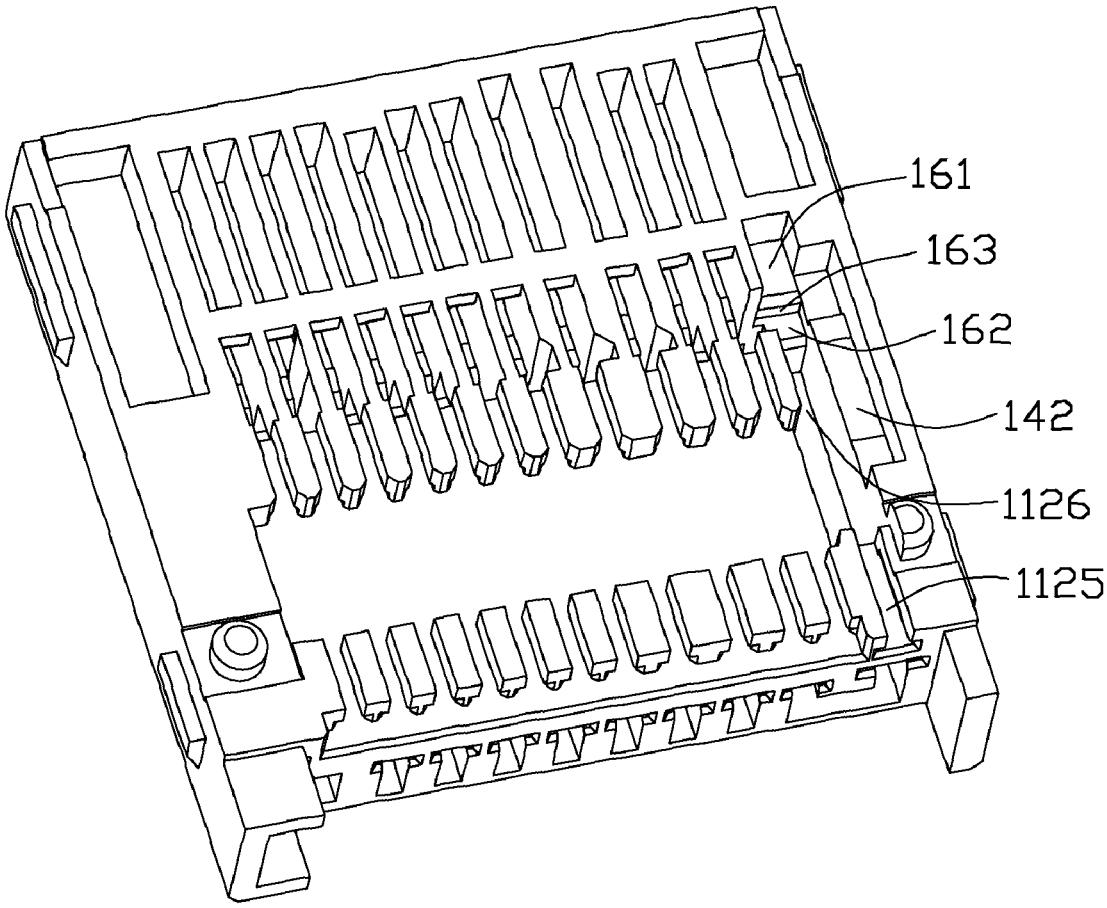
FIG. 7 is a perspective view of the insulative housing shown in FIG. 2.

Referring to FIGS. 4 and 6, the switch terminals 3 comprise a first terminal 31 and a second terminal 32 contacting with each other along the up to down direction when the second electronic card is inserted into the receiving space 10. The first terminal 31 has a main portion 311, a first connecting portion 3113 upwardly and forwardly extending from a front end of the main portion 311, a limiting portion 3115 forwardly extending from a front end of the connecting portion 3113 to upwardly resist the first step surface 161, a guiding portion 312 sidewardly extending from one side of the limiting portion 3115, and a first soldering portion 3114 extending out of the mounting wall 12 from a rear end of the main portion 311. The main portion 311 has a first fastening portion 3111 fastened in the second mounting slot 1125 and a first middle portion 3112 forwardly extending into the fourth receiving slot 1126. The guiding portion 312 moves along the pre-pressing surface 142 in an assembly process of the first terminal 31.

Figure 3:
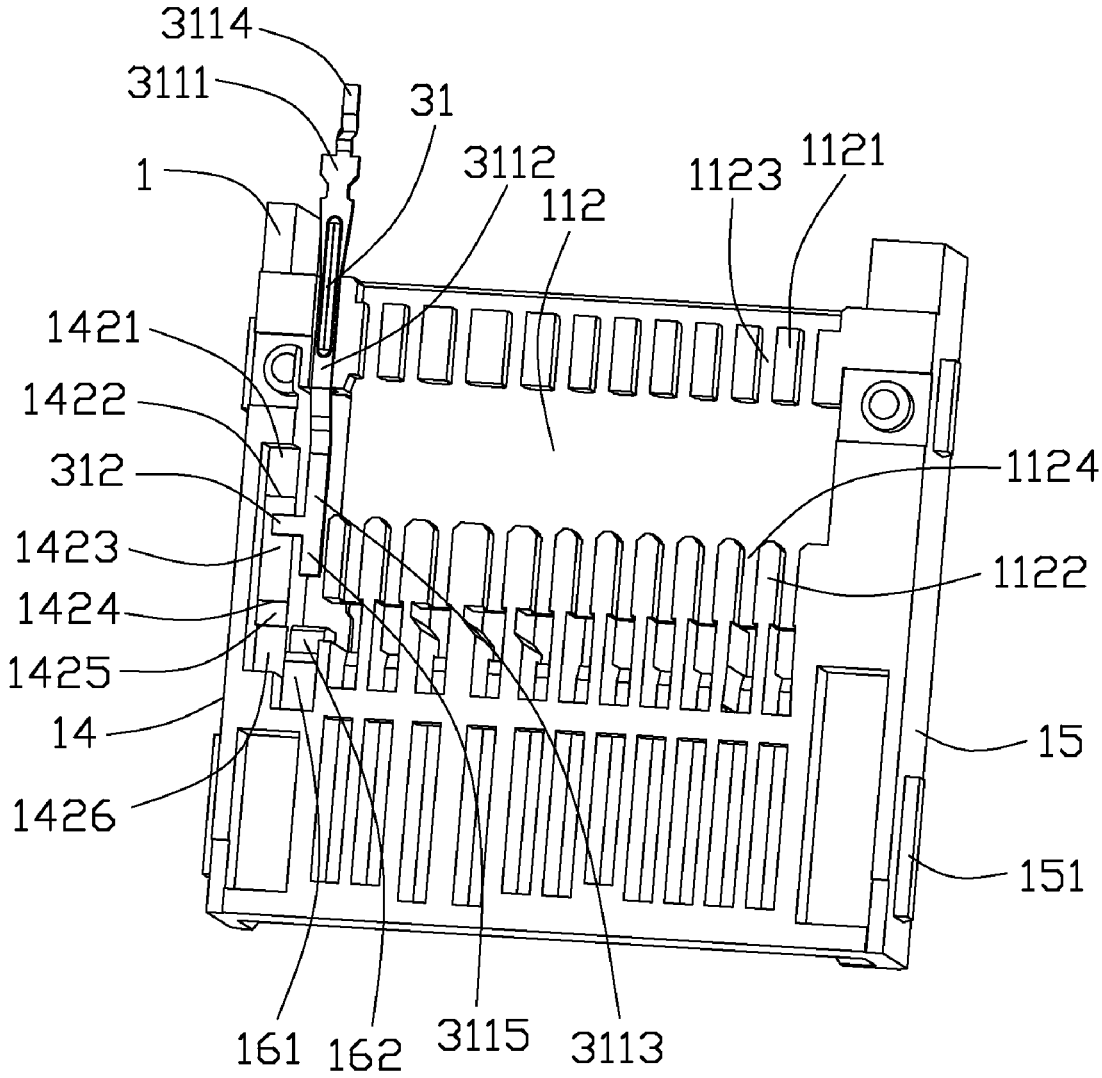
FIG. 3 is another partly perspective view of the electronic card connector shown an assembly process of the first terminal shown in FIG. 2.

In an assembly process of the first terminal 31, the guiding portion 312 moves along the pre-pressing surface 142 to guide the first terminal 31 to be retained to the insulative housing 1. Referring to FIG. 3, the second mounting slot 1125 defines a width which is wider than or similar to that of the first middle portion 3112. Therefore, in the assembly process of the first terminal 31: firstly, assembling the first terminal 31 to the bottom wall 11 along a lower to up direction, at this time, the middle portion 3112 are received in the second mounting slot 1125, and the guiding portion 312 upwardly resists the first level surface 1421 for limiting the limiting portion 3115 to a first height which is lower than the first step surface 161; secondly, pushing the first terminal 31 forwardly, then the guiding portion 312 forwardly moves through the inclined surface 1423 and gradually bounces upwardly to resist the second level surface 1425, at this time, a front end of the limiting portion 3115 is located below the first step surface 161 because the first step surface 161 is lower than the second level surface 1425; finally, further pushing the first terminal 31 forwardly, referring to FIG. 2, the first fastening portion 3111 is retained in the second mounting slot 1125, the guiding portion 312 forwardly moves out of the second level surface 1425 and cantileveredly located between the second level surface 1425 and the third level surface 1426 along the up to down direction, and the limiting portion 3115 further rebound upwardly to resist the first step surface 161, and the connecting portion 3113 is received in a lower side of the fourth receiving slot 1126.

As described above, the limiting portion 3115 is limited below the first step surface 161 before the first terminal 31 is fully assembled to the insulative housing 1, therefore, the limiting portion 3115 can not collide with the vertical surface 163 of the limiting block 16, and the first terminal 31 can not be distorted.

The second terminal 32 has a second fastening portion 321 retained in a lateral third mounting slot 121, a second middle portion 322 forwardly extending from a front end of the second fastening portion 321, a first mating portion 323 forwardly and upwardly protruding into the receiving space 10 to contact with the second electronic card and a second mating portion 325 forwardly extending from a front end of the first mating portion 323. The second mating portion 325 upwardly resists the second step surface 162, and is located at an upper side of the connecting portion 3113. The second mating portion 325 can moves downwardly to connect with the first connecting portion 3113 when the second electronic card is inserted into the receiving space 10 and downwardly presses the first mating portion 323. The second terminal 32 is assembled to the insulative housing 1 along the back to front direction before the first terminal 31 is assembled.

The metal shell 4 is stamped by a metal sheet and has a top wall 41 and a pair of first and second flanges 42, 43 bending downwardly from two sides of the top wall 41. The first and second flanges 42, 43 define a plurality of locking holes 421 to lock with the protrusions 151.

As fully described above, the insulative housing 1 is formed with the pre-pressing surface 142 with the first level surface 1421, the inclined surface 1423 and the second level surface 1425, and the first level surface 1421, the inclined surface 1423 and the second level surface 1425 present as a pre-pressing section which is lower than the first step surface 161 of the limiting block 16 and located behind the first step surface 161 along the front to back direction. Therefore, the limiting portion 3115 can be limited below the first step surface 161 before the first terminal 31 is fully assembled to the insulative housing 1, and the limiting portion 3115 can not collide with the vertical surface 163 of the limiting block 16, then the first terminal 31 can not be distorted.

Of course, the first level surface 1421, the inclined surface 1423 and the second level surface 1425 can be alternatively designed as a common plane surface which is lower than the first step surface 161 of the limiting block 16 and located behind the first step surface 161, and a front side of the limiting portion 3115 moves to a lower side of the first step surface 161 when the guiding portion 312 moves to a front side of the common level plane, which can also prevent the limiting portion 3115 from colliding with the vertical surface 163 to make the first terminal 31 be distorted. In addition, the first level surface 1421 can be alternatively designed to be higher than the second level surface 1425, and the inclined surface 1423 gradually be lower from a front end of the first level surface 1421 to a rear end of the second level surface 1425, and the second level surface 1425 is also higher than the first step surface 161, which can also reach a same purpose as the present invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electronic card connector, comprising:

an insulative housing having a receiving space, a receiving slot communicating with the receiving space along an up to down direction and a limiting block at a front side of the receiving slot;

a plurality of contacts retained on the insulative housing; and a first switch terminal having a fastening portion retained on the insulative housing, a connecting portion forwardly extending to the receiving slot, a limiting portion forwardly extending to a lower side of the limiting block and a tail portion extending out of the insulative housing;

wherein the switch terminal has a guiding portion extending sidewardly, the insulative housing has a pre-pressing surface at one side of the receiving slot to pre-press the guiding portion and prevent the switch terminal from bouncing upwardly to resist a front side of the limiting block in an assembly process of the switch terminal.

2. The electronic card connector as claimed in claim 1, wherein the guiding portion sidewardly extends from a rear side of the limiting portion to move along the pre-pressing surface in the assembly process of the first switch terminal.

3. The electronic card connector as claimed in claim 2, wherein the limiting block has a first step surface at a lower side thereof to press the limiting portion, and the pre-pressing surface has a pre-pressing section which is located behind the first step surface along a front to back direction and lower than the first step surface along the up to down direction for limiting the first switch terminal to a position below the first step surface before the limiting portion forwardly moves to a lower side of the first step surface.

4. The electronic card connector as claimed in claim 3, wherein the pre-pressing surface has a third level surface at a front side of the pre-pressing section and outside of the first step surface, and the third level surface is higher than the first step surface and the pre-pressing section to make the limiting portion of the first switch terminal upwardly rebound to resist the first step surface when the first switch terminal is completely assembled to the insulative housing.

5. The electronic card connector as claimed in claim 3, wherein the pre-pressing section has a second level surface horizontally extending at a front position thereof, and the limiting portion is located below the first step surface and aligned to the first step surface along an up to down direction when the guiding portion moves to the second level surface.

6. The electronic card connector as claimed in claim 5, wherein the pre-pressing section further has a first level surface horizontally extending at a rear position thereof and an inclined surface connecting the first and second level surface, the first level surface is lower than the second level surface.

7. The electronic card connector as claimed in claim 3, wherein the insulative housing has a bottom wall with a second mounting slot recessed from a lower side thereof to fasten the fastening portion, the pre-pressing surface is located at a front side of the second mounting slot along the front to back direction, the first switch terminal has a first middle portion connecting the fastening portion and the connecting portion, and the mounting slot is wider than or similar to the first middle portion to make first the switch terminal firstly be assembled to the insulative housing from a lower side thereof and then moving the fastening portion to the second mounting slot along a back to front direction.

8. The electronic card connector as claimed in claim 7, further comprising a second switch terminal at an upper side of first switch terminal to connect with the first switch terminal along an up to down direction, the insulative housing defines a third mounting slot at an upper side of the second mounting slot, and the second switch terminal has a second fastening portion retained in the second mounting slot, a first mating portion cantileveredly received in the receiving slot and upwardly protruding into the receiving space and a second mating portion forwardly extending from the first mating portion to electrically connect with the connecting portion when an electronic card presses the second mating portion downwardly.

9. The electronic card connector as claimed in claim 8, wherein the limiting block has a second step surface higher than the first step and a vertical surface connecting the first and second step surfaces, the second mating portion is located below the second step surface and upwardly resists the second step surface.

10. An electronic card connector, comprising:

an insulative housing having a receiving space, a receiving slot communicating with the receiving space and a limiting block at a front side of the receiving slot;

a plurality of contacts retained on the insulative housing; and a first switch terminal having a fastening portion retained on the insulative housing, a middle portion forwardly extending from a front end of the fastening portion, a connecting portion upwardly and forwardly extending from middle portion to the receiving slot, a limiting portion forwardly extending to a bottom surface of the limiting block and a tail portion extending out of the insulative housing;

wherein the insulative housing has a pre-pressing section behind the limiting block along a front to back direction, the pre-pressing section is lower than the bottom surface and pre-presses the connecting portion downwardly to prevent the connecting portion from bouncing upwardly to resist a front side of the limiting block in an assembly process of the first switch terminal.

11. The electronic card connector as claimed in claim 10, wherein the insulative housing further has a recessed portion at a front side of the pre-pressing section to make the limiting portion bounce upwardly to resist the bottom surface of the limiting block when the first switch terminal is fully assembled to the insulative housing.

12. The electronic card connector as claimed in claim 11, wherein the pre-pressing section and the recessed portion are located at an outer side of the receiving slot, and the first switch terminal has a guiding portion sidewardly extending from the limiting portion to move along the pre-pressing section on the assembly process of the first switch terminal.

13. The electronic card connector as claimed in claim 12, wherein the guiding portion is cantileveredly received in the recessed portion when the first switch terminal is fully assembled to the insulative housing.

14. The electronic card connector as claimed in claim 11, wherein the insulative housing has a bottom wall with a second mounting slot recessed from a lower side thereof to fasten the fastening portion, the pre-pressing section is located at a front side of the second mounting slot along the front to back direction, the first switch terminal has a first middle portion connecting the fastening portion and the connecting portion, and the mounting slot is wider than or similar to the first middle portion to make first the switch terminal firstly be assembled to the insulative housing from a lower side thereof and then moving the fastening portion to the second mounting slot along a back to front direction.

15. The electronic card connector as claimed in claim 14, further comprising a second switch terminal at an upper side of first switch terminal to connect with the first switch terminal along an up to down direction, the insulative housing defines a third mounting slot at an upper side of the second mounting slot, and the second switch terminal has a second fastening portion retained in the second mounting slot, a first mating portion cantileveredly received in the receiving slot and upwardly protruding into the receiving space and a second mating portion forwardly extending from the first mating portion to electrically connect with the connecting portion when an electronic card presses the second mating portion downwardly.

16. An electrical card connector comprising:

an insulative housing defining a receiving space for receiving an electronic card, and further defining a front a front limiting block, a middle receiving slot and a rear mounting slot all essentially aligned with one another in a front-to-back direction, and a pre-pressing surface located beside said middle receiving slot along a transverse direction perpendicular to said front-to-back direction; and a switch terminal including a front limiting portion, a middle contact portion and a rear fastening portion along said front-to-back direction, and a guiding portion located around the middle contact portion in said transverse direction; wherein said switch terminal is assembled, in an initial stage, to the housing initially along a vertical direction perpendicular to both said front-to-back direction and said transverse direction under condition that the guiding portion forcibly presses against the pre-pressing surface in said vertical direction while the front limiting portion is free from the front limiting block without imposing pressure upon the housing, and successively along a back-to-front direction opposite to said front-to-back direction so as to have the rear fastening portion assembled into the rear mounting slot to obtain retention of the switch terminal with regard to the housing in the vertical direction, in a final stage, under condition that the front limiting portion resiliently abuts against the front limiting block in said vertical direction.

17. The electrical card connector as claimed in claim 16, wherein in a final stage, the middle contact portion of the switch terminal is expose to the middle receiving slot in the vertical direction for coupling with another switch terminal.

18. The electrical card connector as claimed in claim 17, wherein said another switch terminal extends into the receiving space and is adapted to be actuated by an electron card to enter into said receiving slot for coupling to said switch terminal.

19. The electrical card connector as claimed in claim 16, wherein an engagement between the guiding portion of the switch terminal and the pre-pressing surface of the housing in the initial stage sets the switch terminal at a first level while another engagement between the front limiting portion of the switch terminal and the front limiting block of the housing in the final stage sets the switch terminal at a second level closer to the receiving slot in said vertical direction than said first level.

20. The electrical card connector as claimed in claim 16, wherein in the final stage, the guiding portion is free from the pre-pressing surface without imposing pressure upon the housing in said vertical direction.

* * * * *